US006039508A

United States Patent [19]

White

[11] Patent Number: 6,039,508

[45] Date of Patent: Mar. 21, 2000

[54] APPARATUS FOR INSERTING ELONGATE MEMBERS INTO THE EARTH

[75] Inventor: John L. White, Kent, Wash.

[73] Assignee: American Piledriving Equipment, Inc., Kent, Wash.

[21] Appl. No.: 08/900,481

[22] Filed: Jul. 25, 1997

[51] Int. Cl.[7] ..... E02D 7/00; E02D 7/26

[52] U.S. Cl. ..... 405/232; 405/50; 254/95; 175/55; 175/56

[58] Field of Search ..... 405/50, 198, 232; 254/95, 97; 175/19, 55, 56, 162; 166/71, 77.1

[56] References Cited

U.S. PATENT DOCUMENTS

| | | | |
|---|---|---|---|
| 628,962 | 7/1899 | Speer . | |
| 1,288,989 | 12/1918 | Rees | 254/97 |
| 1,322,470 | 11/1919 | Schenk . | |
| 1,654,093 | 12/1927 | Reid . | |
| 1,903,555 | 4/1933 | Robertson . | |
| 2,577,252 | 12/1951 | Kjellman . | |
| 2,952,132 | 9/1960 | Urban . | |

(List continued on next page.)

FOREIGN PATENT DOCUMENTS

| | | |
|---|---|---|
| 0172960A1 | 3/1986 | European Pat. Off. . |
| 0526743B1 | 8/1995 | European Pat. Off. . |
| 838717 | 3/1939 | France . |
| 2560247 | 2/1984 | France . |
| 42349 | 1/1938 | Netherlands . |
| 65252 | 1/1950 | Netherlands . |
| 65252 | 2/1950 | Netherlands . |
| 7707303 | 7/1977 | Netherlands . |
| 7710385 | 9/1977 | Netherlands . |
| 7805153 | 5/1978 | Netherlands . |
| 7707303 | 1/1979 | Netherlands . |
| 7805153 | 11/1979 | Netherlands . |
| 92-16944 | 9/1992 | Rep. of Korea . |
| 1027357 | 7/1983 | Russian Federation . |
| 1027357A | 7/1983 | Russian Federation . |
| 2003769A | 8/1978 | United Kingdom . |
| 2023496A | 1/1980 | United Kingdom . |
| 2028902B | 8/1982 | United Kingdom . |
| WO87/07673 | 12/1987 | WIPO . |
| WO88/05843 | 8/1988 | WIPO . |

OTHER PUBLICATIONS

A series of photographs identified by reference No. APE01147 through APE01159. (Undated).

Japanese language brochure entitled "Castle Board Drain Method", (Aug. 1976).

"The 1st Report on the Treatment of Soft Foundation of Juck Hyun Industrial Site" (Ref. Nos. APE00854 through APE00856).

Schematic drawings identified by Ref. Nos. APE01038, APE01039, and APE0339. (Undated).

A report identifying systems for driving mandrels carrying wick drain material into the earth, identified by Ref. Nos. APE0510 through APE0536. (Undated).

Korean language document identified by reference No. APE00864 through APE0089;1 (From 1982 to 1997).

*Primary Examiner*—David Bagnell
*Assistant Examiner*—Jong-Suk Lee
*Attorney, Agent, or Firm*—Hughes & Schacht, P.S.; Michael R. Schacht

[57] ABSTRACT

A system for inserting elongate members into and removing elongate members from the ground. The system is a bottom drive system that is capable of applying crowding or extraction forces to the elongate member while at the same time vibrating the elongate member along its axis. A vibratory assembly is mounted by a shock absorbing assembly to a support base. A gear or other type of drive assembly is mounted on the vibratory assembly. Vibratory forces generated by the vibratory assembly are applied to the elongate member through the drive assembly, causing the drive assembly to vibrate with the elongate member. The elongate member extends through the center of the vibratory assembly such that the vibratory forces have a vibratory axis that is aligned with the lengthwise axis of the elongate member to prevent torsional or twisting forces from being applied to the elongate member.

25 Claims, 6 Drawing Sheets

U.S. PATENT DOCUMENTS

| | | | |
|---|---|---|---|
| 3,172,485 | 3/1965 | Spannhake et al. . | |
| 3,300,987 | 1/1967 | Maeda | 405/50 |
| 3,313,376 | 4/1967 | Holland, Sr. . | |
| 3,381,422 | 5/1968 | Olson . | |
| 3,391,435 | 7/1968 | Lebelle | 405/232 X |
| 3,684,037 | 8/1972 | Bodine | 175/56 |
| 3,871,617 | 3/1975 | Majima | 405/232 X |
| 3,874,244 | 4/1975 | Rasmussen et al. . | |
| 3,891,186 | 6/1975 | Thorsell . | |
| 3,907,042 | 9/1975 | Halwas et al. . | |
| 4,082,361 | 4/1978 | Lanfermann . | |
| 4,155,600 | 5/1979 | Lanfermann et al. . | |
| 4,166,508 | 9/1979 | van den Berg . | |
| 4,195,698 | 4/1980 | Nakagawasai . | |
| 4,428,699 | 1/1984 | Juhola . | |
| 4,455,105 | 6/1984 | Juhola . | |
| 4,537,527 | 8/1985 | Juhola et al. . | |
| 4,553,443 | 11/1985 | Rossfelder et al. | 175/55 X |
| 4,601,615 | 7/1986 | Cavalli . | |
| 4,627,768 | 12/1986 | Thomas et al. . | |
| 4,735,270 | 4/1988 | Fenyvesi . | |
| 4,755,080 | 7/1988 | Cortlever et al. | 405/232 X |
| 4,813,814 | 3/1989 | Shibuta et al. | 254/95 X |
| 4,863,312 | 9/1989 | Cavalli . | |
| 5,117,925 | 6/1992 | White . | |
| 5,213,449 | 5/1993 | Morris | 405/232 |
| 5,263,544 | 11/1993 | White . | |
| 5,281,775 | 1/1994 | Gremillion . | |
| 5,355,964 | 10/1994 | White . | |
| 5,439,326 | 8/1995 | Goughnour et al. | 405/50 X |
| 5,544,979 | 8/1996 | White . | |
| 5,609,380 | 3/1997 | White . | |
| 5,658,091 | 8/1997 | Goughnour et al. | 405/50 |

454
458
450
550
554
448
428
464
420
462
430
422
426
456
548
478
424
544
444
546
552
556
442
432
446
560
558
460
520
522
436
482
472
470
438
540
542
536
480
502
500
434
A
496
562

APPARATUS FOR INSERTING ELONGATE MEMBERS INTO THE EARTH

TECHNICAL FIELD

The present invention relates to methods and apparatus for inserting into the earth and extracting from the earth elongate members and, more particularly, to apparatus and methods for inserting wick drain material into the earth.

BACKGROUND OF THE INVENTION

For certain construction projects, elongate members such as piles, anchor members, caissons, and mandrels for inserting wick drain material must be placed into and in some cases withdrawn from the earth. It is well-known that, in many cases, such rigid members may be driven into and withdrawn from the earth without prior excavation.

The present invention is particularly advantageous when employed to insert a mandrel carrying wick drain material into the earth, and that application will be described in detail herein. However, the present invention may have broader application to the insertion into and removal from the ground of other elongate members such as piles, anchor members, and caissons, especially when these members must be driven at an angle with respect to horizontal. Accordingly, the scope of the present invention should be determined by the scope of the claims appended hereto and not the following detailed description.

Because wick drain material is flexible, it cannot be directly driven into the earth. Instead, it is normally placed within a rigid mandrel that is driven into the earth. Once the mandrel and wick drain material have been driven into the earth, the mandrel alone is removed from the earth, leaving the wick drain material in place. The wick drain material that is left in place wicks moisture in its vicinity to the surface to stabilize the ground at that point.

Two basic systems are employed to drive mandrels into and remove mandrels from the earth. A first system is referred to as a top drive system and engages the upper end of the mandrel to insert the mandrel into the earth. In a top drive system, the upper end of the mandrel is securely attached to the drive system and forced downward or upward to insert the mandrel into or remove the mandrel from the ground. The upper end of the mandrel may also be vibrated by a vibratory drive means and/or crowded by a chain or cable drive means to cause the mandrel to penetrate the earth.

The primary disadvantage with the top drive system is that they require a substantial boom structure to support the mandrel and associated drive means. The requirement of a large and heavy boom structure limits the length of the mandrel that may be driven by a top drive system. Further, as the ground into which the wick drain material is to be inserted may be wet and unstable, the ground may not be sufficiently stable to support the required boom structure. Top drive systems thus may be inappropriate in certain situations.

A second system for inserting and removing mandrels engages the bottom end of the mandrel and will be referred to herein as a bottom drive system. A bottom drive system is not attached to any one point on the mandrel; instead, rotating roller surfaces and/or gear teeth engage the mandrel in a manner that displaces the mandrel along its axis to drive it into the ground. Bottom drive systems require a boom sufficient to support only the mandrel; the boom for a bottom drive system may thus be significantly lighter than that for a top drive system, which alleviates some of the problems associated with large booms.

However, the primary disadvantage with known bottom drive systems is that they rely entirely on the roller or gear drive system for insertion and removal of the mandrel. Bottom drive system do not have the benefit of a vibratory device for situations in which the mandrel becomes stuck due to soil conditions.

RELATED ART

U.S. Pat. No. 5,213,449 to Morris shows, and USSR Patent No. SU 1027357 appears to show, bottom drive devices for driving a mandrel into the ground. The Morris patent discloses a gear dive system and the USSR patent appears to show a roller drive system.

Top drive wick drain inserters are disclosed in U.S. Pat. No. 3,891,186 to Thorsell, U.S. Pat. No. 4,166,508 to van den Berg, U.S. Pat. No. 4,755,080 to Cortlever et al., Dutch Pat. No. 65252, Dutch Pat. No. 7805153, and Dutch Pat. No. 7,707,303.

The Thorsell patent employs a chain attached to the top of a wick drain mandrel to crowd the mandrel into the ground.

The van den Berg patent employs a two-part mandrel, with the two parts being wound around rollers and crowded into the ground by unwinding the rollers.

The Cortlever et al. patent discloses a cable connected to the upper end of the mandrel and a hydraulic system for displacing the cable to drive or crowd the mandrel into the ground.

The Dutch '252 and '153 patents appear to employ a chain to drive or crowd a mandrel into the ground.

In the Dutch '703 patent, a vibratory device appears to be fixed to the top end of the mandrel to drive the mandrel into the ground.

Shown in U.S. Pat. Nos. 5,117,544 and 5,117,925 issued to the Applicant are vibratory devices for driving piles into the earth. These patents disclose placing the vibratory device on top of the pile to be driven and vibrating the pile along its axis; the combination of the vibratory forces along the axis of the pile and the weight of the pile and vibratory device drives the pile into the ground. Caissons may be driven into the ground in the same manner.

OBJECTS OF THE INVENTION

In view of the foregoing, it is apparent that an important object of the present invention is to provide improved apparatus and methods for driving elongate members into and removing elongate members from the ground. Another important, but more specific, object of the present invention is to provide apparatus and methods for inserting and removing elongate members having a favorable mix of the following factors:

a. does not require a large boom;

b. allows elongate members to be inserted and withdrawn at angles with respect to vertical;

c. allows the use of vibratory forces to facilitate insertion and removal of elongate members;

d. allows the insertion of relatively long elongate members;

e. can insert and remove elongate members at relatively high speeds;

f. employs a bottom drive system that is capable of crowding and vibrating the elongate member at the same time;

g. employs a mandrel having a small footprint; and g. applies vibratory forces to the elongate member along the axis thereof in a manner that prevents torsional forces from being applied to the elongate member.

SUMMARY OF THE INVENTION

The present invention is a bottom drive system for inserting and removing elongate members that employs a vibratory assembly and a gear drive assembly. The gear drive assembly is mounted on the housing of the vibratory assembly such that it can engage one or more racks on an elongate member to be driven into the ground. A shock absorbing assembly is provided to attach the vibratory housing to a support base that engages the ground. The gear drive assembly vibrates with the vibratory device and thus allows both vibratory and crowding forces to be applied to the elongate member.

This arrangement allows the elongate member to be crowded into the ground using the gear drive assembly at the same time it is vibrated along its axis by the vibratory assembly. The combination of crowding forces and vibratory forces greatly increases the speed at which the elongate member may be inserted into the ground and the ability of the system to overcome the resistance to such insertion caused by adverse soil conditions.

A hole or passageway is centrally located in the housing of the vibratory assembly. The elongate member extends through this passageway. The vibratory forces generated by the vibratory assembly result from two eccentric weight members that are rotated in opposite directions such that lateral forces are cancelled out and only vertical vibratory forces remain. These eccentric members are symmetrically located on opposite sides of the elongate member such that the vibratory forces applied to the elongate member are along the axis of the elongate member. The central location of the passageway between the eccentric members results in almost no torsional loads being applied to the elongate member. This arrangement results in relatively little wear caused by the vibratory forces on the elongate member and the structure that transmits the vibratory forces to the elongate member.

Hydraulic cylinders may be placed on the vibratory housing such that they grip the elongate member therebetween to fix the elongate member relative to the housing of the vibratory assembly. This allows the vibratory forces to be transmitted to the elongate member via a path other than through the gear drive assembly, reducing the wear on the gear drive assembly.

Hydraulic pistons may also be placed on the vibratory housing to generate an alternative crowding force in situations where the crowding force generated by the gear drive assembly is insufficient to move the elongate member through the soil. These pistons are fixed at one end relative to the housing. The other end of these pistons engages the elongate member. When hydraulic fluid is applied to the pistons, they lengthen or shorten, thereby causing the elongate member to move along its axis. The large crowding and extracting forces generated by these pistons may be sufficient to move the elongate member where the forces generated by the gear drive assembly were not.

The vibratory housing may also be fixed to a ring that is rotatable about the axis of the mandrel relative to the support base on which the vibratory assembly is mounted. Rotating this ring rotates the entire vibratory assembly and thus the mandrel being driven thereby. Such rotation of the mandrel may facilitate movement of the mandrel along its axis under certain soil conditions. In this case, the mandrel should be round to allow it to rotate in the soil more easily.

DETAILED DESCRIPTION OF THE INVENTION

1. First Embodiment

Figure 1:
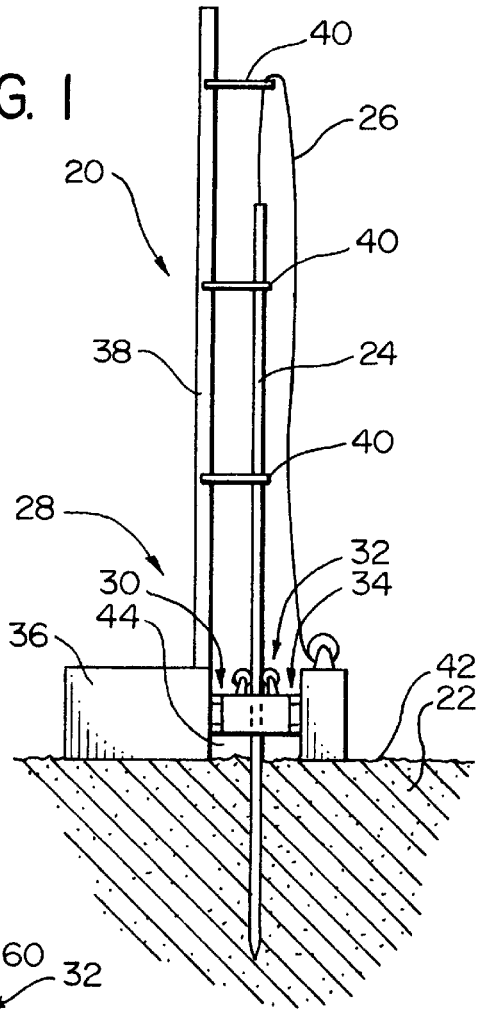
FIG. 1 is a side plan view of a first elongate member insertion/removal system that is constructed in accordance with the principles of the present invention.

Turning now to the drawing, depicted at 20 in FIG. 1 is an elongate member insertion/withdrawal system constructed in accordance with, and embodying, the principles of the present invention. The system 20 is particularly designed to insert into and remove from the ground 22 a mandrel 24 carrying wick drain material 26.

The system 20 basically comprises a support assembly 28, a vibratory assembly 30, a gear drive assembly 32, and a shock absorbing assembly 34. The support assembly 28 comprises a support base 36, a mast 38, and mandrel support 40. The support base 36 is designed to engage a surface 42 of the ground 22 and provide a solid, stable surface for supporting the mast 38. The support base 36 can be a self-propelled platform such as a tracked vehicle or may, as shown, be placed directly onto the ground surface 42.

The mast 38 vertically extends from the support base 36, and the mandrel supports 40 horizontally extend from vertically spaced locations on the mast 38. The mandrel 24 is encircled by the mandrel supports 40 before and during insertion of the mandrel 24 into the ground 22. The support assembly 28 thus maintains the mandrel 24 in a desired orientation with respect to the ground; in the exemplary system 20, this desired orientation is vertical.

The vibratory assembly 30 is located in a channel 44 extending from top to bottom through the support base 36. The shock absorbing assembly 34 mounts the vibratory assembly 30 within the channel 44 in a manner that: (a) maintains the vibratory assembly 30 in a desired location relative to the ground 22; and (b) absorbs vibratory forces generated by the vibratory assembly 30 and thus reduces the transmission of these forces to the support means. The vibratory assembly 30 is thus free to vibrate up and down within the channel 44, and only acceptably low levels of vibration are transmitted to the support base 36.

Figure 2:
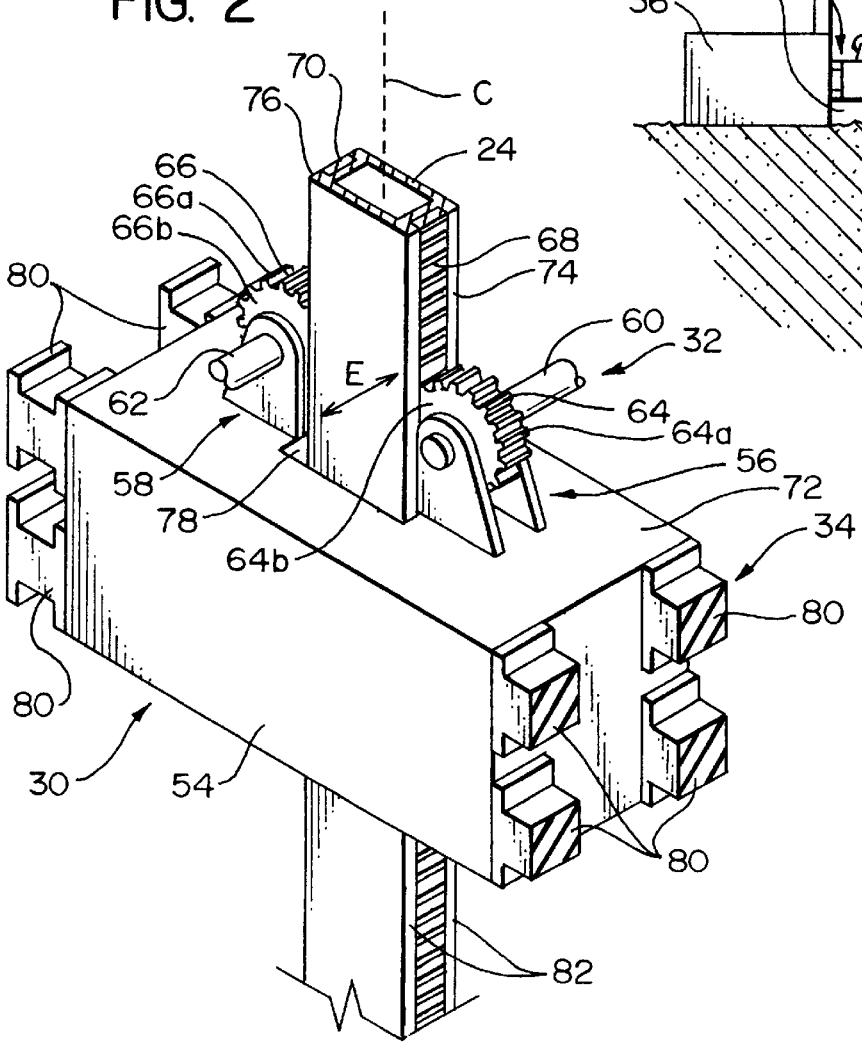
FIG. 2 is a perspective view of the vibratory assembly, gear drive assembly, and shock absorbing assembly of the system depicted in FIG. 1
Figure 3:
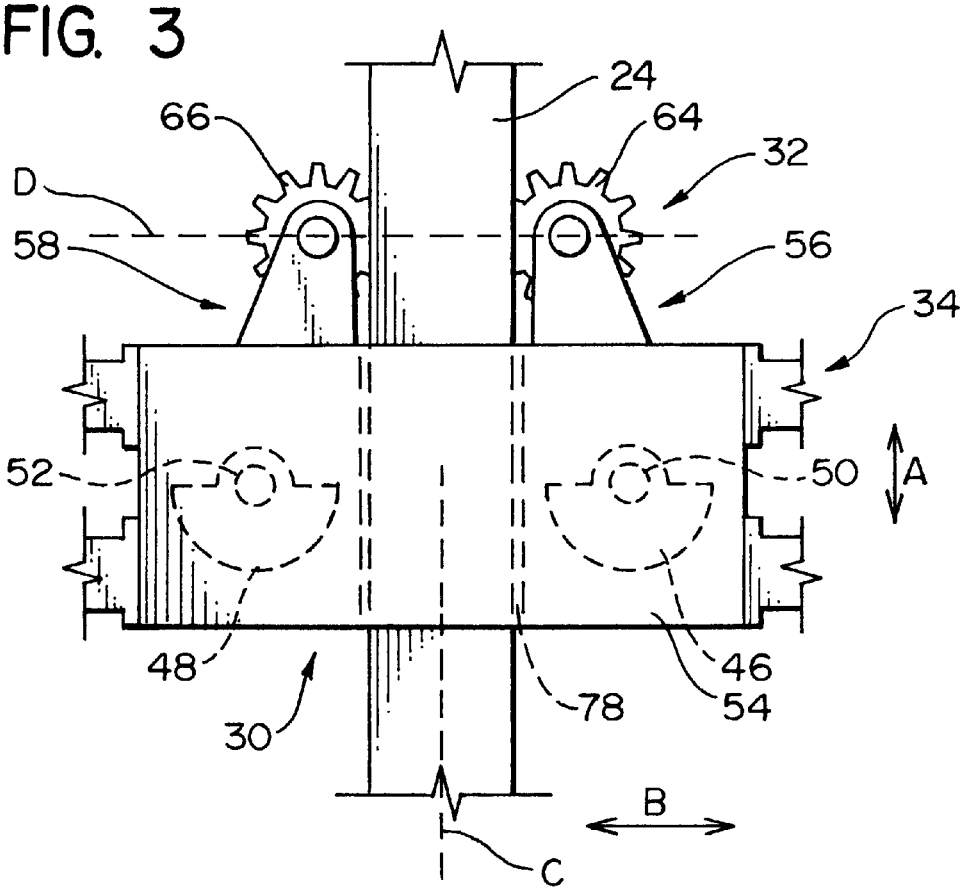
FIG. 3 is a side plan view of the assemblies depicted in FIG. 2.

Referring now to FIGS. 2 and 3, depicted in more detailed therein are the mandrel 24, the vibratory assembly 30, the gear drive assembly 32, and the shock absorbing assembly 34.

Referring initially to the vibratory assembly 30, FIG. 3 shows that this assembly 30 comprises first and second eccentric weight members 46 and 48 fixed onto vibratory shafts 50 and 52 mounted within a housing 54. The vibratory shafts 50 and 52 are horizontal and parallel to each other.

To cause the housing 54 to vibrate the vibratory shafts 50 and 52 are rotated by motors (not shown) at the same speed in opposite directions to cause the eccentric members 46 and 48 to rotate about the axes of these shafts 50 and 52. The eccentric members 46 and 48 are mounted on the vibratory shafts 50 and 52 such that: (a) the lateral forces on the housing 54 (in the direction of arrow B in FIG. 3) generated by the eccentric members 46 and 48 substantially cancel each other; while (b) the vertical forces on the housing 54 (in the direction of arrow A in FIG. 3) generated by the eccentric members 46 and 48 are added to each other. The result is that this rotation of the eccentric members 46 and 48 causes the housing 54 to vibrate with great force along a vibratory axis in the vertical direction and very little in the lateral direction.

The gear drive assembly 32 is perhaps best shown in FIG. 2. The gear drive assembly 32 basically comprises first and second bracket assemblies 56 and 58, first and second drive shafts 60 and 62, and first and second drive gears 64 and 66, and first and second drive racks 68 and 70. The bracket assemblies 56 and 58 are securely attached to an upper surface 72 of the vibratory housing 54. The drive shafts 60 and 62 are mounted on the bracket assemblies 56 and 58, respectively, above the housing surface 72 such that the shafts 60 and 62 can be rotated about their axes. The drive gears 64 and 66 are mounted on the drive shafts 60 and 62 such that the gears 64 and 66 are securely held at a fixed distance above the housing surface 72.

The first and second drive racks 68 and 70 are formed on opposite surfaces 74 and 76 of the mandrel 24. The mandrel 24 extends through a vertical mandrel passageway 78 formed in the housing 54 such that the racks 68 and 70 engage teeth 64*a* and 66*a* of the drive gears 64 and 66.

Accordingly, rotation of the drive shafts 60 and 62 in the opposite direction by a motor (not shown) causes the drive gears 64 and 66 to rotate, which in turn causes the gear teeth 64*a* and 66*a* to engage the drive racks 68 and 70 to displace the mandrel 24 along its lengthwise axis C (FIG. 2). In this fashion, the mandrel 24 can be moved either up or down along its axis C relative to the vibratory housing 54.

At this point, it should be noted that the unshown motors employed to turn the vibratory shafts 50 and 52 and the drive shafts 60 and 62 should be direct fluid to torque hydraulic motors. The motors should be able to withstand severe vibration because they must be mounted on the vibratory housing 54, and direct fluid to torque motors are much less susceptible to vibration damage than hydraulic motors employing a planetary gear. Direct fluid to torque hydraulic motors is available from, for example, POCLAIN under the model name CAM TRACK. The source of the pressurized fluid employed to drive these motors is preferably mounted on the support base 36 and connected to the hydraulic motors via flexible hoses. This arrangement of hydraulic motors and fluid source minimizes: (a) the amount of equipment that is directly subjected to the vibratory forces generated by the vibratory assembly 30; and (b) the damage to the equipment that is subjected to these vibratory forces.

Referring now to FIGS. 2 and 3, these Figures show that the shock absorbing assembly 34 comprises eight rectangular solid shock absorbing members 80 (only seven shown in FIG. 2) that are flanged such that they can be bolted to the vibratory housing 54 and the support base 36. These members 80 are made of strong, resilient, rubber-like material. When the vibratory housing 54 vibrates up and down, these shock absorbing members 80 allow the housing to move up and down a short distance relative to the support base 36; in doing so, the members 80 yieldingly resist the transmission of vibratory forces from the vibratory housing 54 to the support base 36. Accordingly, the shock absorbing assembly 34 effectively isolates the support base from the vibratory forces generated by the vibratory assembly 54.

In operation, the mandrel 24 will initially be arranged with a lower end 24*a* thereof adjacent to the surface 42 of the ground 22 and with the wick drain material 26 loaded therein. The drive shafts 60 and 62 will then be rotated to cause the mandrel 24 to enter the ground 22. The downward force applied by the gear drive assembly 32 may in many cases be sufficient to drive the mandrel 24 to the desired depth.

However, in some cases, the soil conditions of the ground 22 may be such that the force applied by the gear drive assembly 32 is insufficient and the mandrel 24 can not be inserted into or withdrawn from the ground 22. In these cases, the vibratory shafts 50 and 52 may be rotated to cause the vibratory housing 54 to vibrate up and down. These vibratory forces will be transmitted to the mandrel 24 at the points where the teeth 64*a* and 66*a* of the drive gears 64 and 66 engage the drive racks 66 and 70. The mandrel 24 will thus be vibrated up and down along its axis C. Such vibration is extremely effective at overcoming resistance to the insertion and withdrawal of the mandrel 24.

Further, the vibratory forces generated by the vibratory assembly 30 may be applied at the same time as the drive forces generated by the gear drive assembly 32; the gear drive assembly 32 is mounted on the vibratory housing 54 and will move up and down at the same rate as the vibratory housing 54. The combination of a driving force and a vibratory force greatly increases the speed at which the mandrel 24 can be inserted into and withdrawn from the ground 22.

The elongate member insertion/withdrawal system 20 thus exhibits all of the benefits of a bottom drive system as described above but in addition allows the use of vibratory forces when soil conditions require such forces and for simply to speed up the process of inserting or removing wick drain mandrels.

Several features of the insertion/withdrawal system 20, while perhaps not essential to the operation of the present invention, are believed to optimize the implementation of the present invention and will not be discussed in further detail.

For example, FIGS. 2 and 3 both show that the vibratory assembly 30 is substantially symmetrically arranged about the axis C of the mandrel 24. More particularly, as shown in FIG. 3 the eccentric members 46 and 48 and shafts 50 and 52 connected thereto are arranged the same distance from the mandrel axis C with the shafts 50 and 52 are orthogonal to this axis C. With this arrangement, the vibratory forces are applied along the mandrel axis C. Without such symmetry, the vibratory forces would cause a torsional load to be exerted on the mandrel 24. Such a torsional load would increase the stress on the mandrel 24 and/or the gear drive assembly 32 that engages the mandrel 24 and thus the likelihood of damage thereto.

Another important feature of the present invention is the location of the drive gears 64 and 66 relative to the mandrel 24. The lateral forces applied on the mandrel 24 by these gears 64 and 66 are in opposite directions along a line D shown in FIG. 3. With this arrangement, it is not necessary to pinch the mandrel 24 at two points in order to displace it along its axis; instead, the gears 64 and 66 need only apply sufficient lateral loads to maintain the mandrel 24 at the center of the passageway 78. This eliminates the need to place a constant load on the mandrel 24 and thus undue stresses thereon. The placement of the gears 64 and 66 also mean that the vertical vibratory forces transmitted to the mandrel 24 are applied in a symmetrical fashion that alleviates twisting of the mandrel 24. The lateral forces applied on the mandrel 24 by these gears 64 and 66 are in opposite directions along a line D shown in FIG. 3. With this arrangement, it is not necessary to pinch the mandrel 24 at two points in order to displace it along its axis; instead, the gears 64 and 66 need only apply sufficient lateral loads to maintain the mandrel 24 at the center of the passageway 78. This eliminates the need to place a constant load on the mandrel 24 and thus undue stresses thereon. The placement of the gears 64 and 66 also means that the vertical vibratory forces transmitted to the mandrel 24 are applied in a symmetrical fashion that alleviates twisting of the mandrel 24.

Another noteworthy feature of the present invention is that the drive racks 68 and 70 are recessed into the mandrel surfaces 74 and 76. This creates ridges 82 extending along the length of the racks 68 and 70 that engage the sides 64*b* and 66*b* of the drive gears 64 and 66 to prevent the mandrel 24 from moving in either direction along an arrow E in FIG. 2; this direction shown by arrow E is orthogonal to the mandrel axis C and to the line D shown in FIG. 3.

2. Second Embodiment

Figure 4:
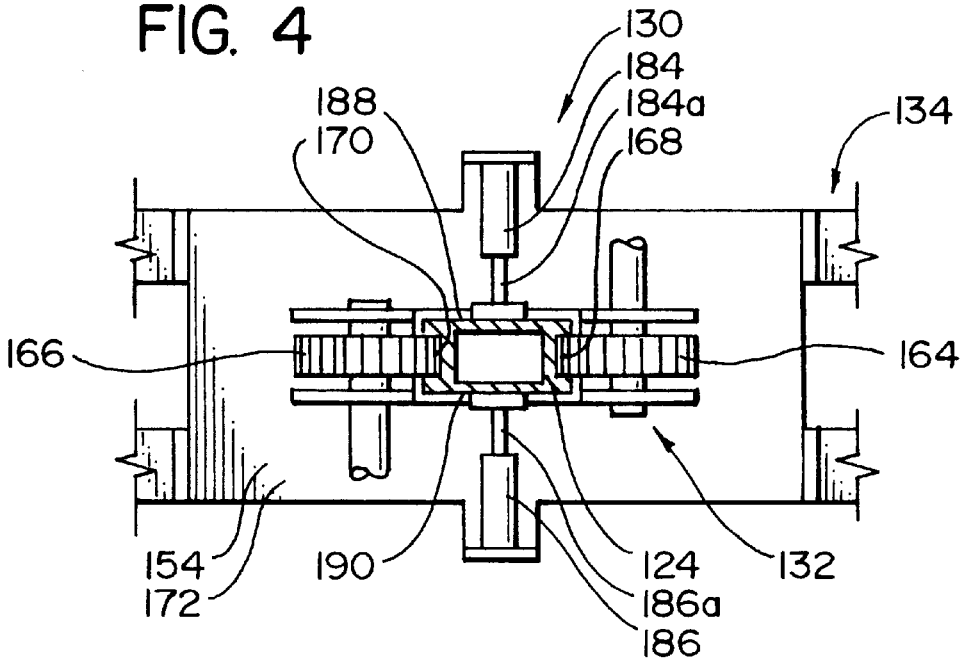
FIG. 4 is a top plan view of a portion of a second exemplary elongate member insertion/removal system that is constructed in accordance with the principles of the present invention.

A second exemplary elongate member insertion/withdrawal system will now be described with reference to FIG. 4. In FIG. 4, components that are the same as those described above with reference to FIGS. 1–3 will be given the same reference character plus one hundred. Such like components will not be described again in detail below.

FIG. 4 shows that securely secured to the upper surface 172 of the vibratory housing 154 are first and second hydraulic piston assemblies 184 and 186. These assemblies 184 and 186 are arranged on opposite sides of the mandrel 124. Pistons 184*a* and 186*a* are extendable from the assemblies 184 and 186, respectively, to engage opposite surfaces 188 and 190 of the mandrel 124.

Thus, by appropriate application of hydraulic fluid to the piston assemblies 184 and 186, the pistons 184*a* and 186*a* of these assemblies can engage the mandrel 124 to fix the position of the mandrel 124 relative to the vibratory housing 154. This allows the vibratory forces generated by the vibratory assembly 130 to be transmitted to the mandrel 124 primarily through the piston assemblies 184 and 186 and only to a lesser extent through the gear drive assembly 132. The piston assemblies 184 and 186 can thus alleviate wear on the drive gears 164 and 166 and the drive racks 168 and 170 in situations where the mandrel 124 is only being vibrated and not driven along its axis.

Figure 5:
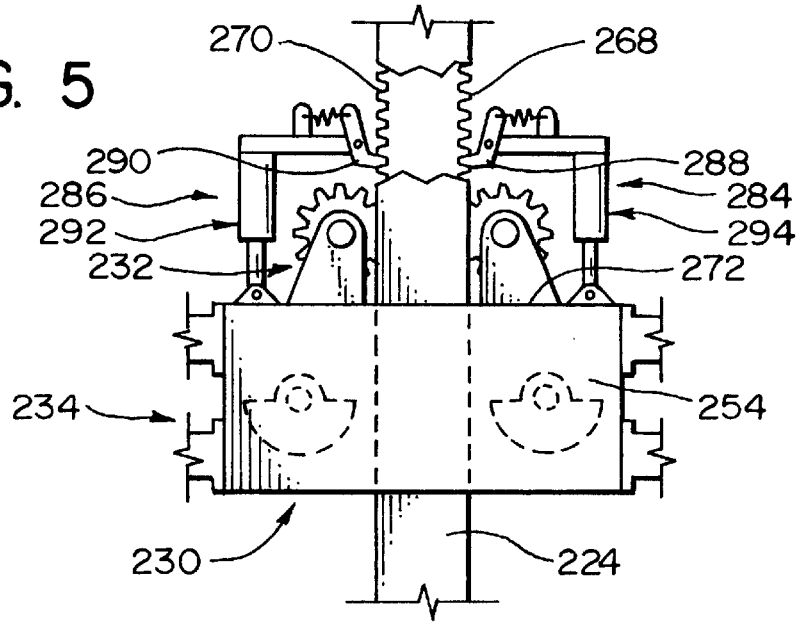
FIG. 5 is a side plan view of a portion of a third exemplary elongate member insertion/removal system that is constructed in accordance with the principles of the present invention.

A third exemplary elongate member insertion/withdrawal system will now be described with reference to FIG. 5. In FIG. 5, components that are the same as those described above with reference to FIGS. 1–3 will be given the same reference character plus two hundred. Such like components will not be described again in detail below.

FIG. 5 shows that securely mounted onto the upper surface 272 of the vibratory housing 254 of this third exemplary system are first and second hydraulic drive assemblies 284 and 286. These hydraulic drive assemblies 284 and 286 are arranged to apply vertical forces on the mandrel 224.

In particular, during normal operation engaging members 288 and 290 of these assemblies 284 and 286 are disengaged from the racks 268 and 270 and the mandrel 224 is driven by the gear drive assembly 232. However, when the forces generated by the gear drive assembly 232 are not sufficient to insert or withdraw the mandrel 224, the engaging members 288 and 290 engage the mandrel 224 through the racks 268 and 270.

Drive piston assemblies 292 and 294 of the hydraulic drive assemblies 284 and 286 are then operated to act on the mandrel 224 through the members 288 and 290 and force the mandrel 224 in either direction along its axis. The forces of the hydraulic drive assemblies 284 and 286 may be sufficient to insert or withdraw the mandrel 224 in cases where the forces generated by the gear drive assembly 232 are not. Further, the hydraulic drive assemblies 284 and 286 will be particularly effective when used in conjunction with vibratory forces generated by the vibratory assembly 230.

3. Third Embodiment

Figure 6:
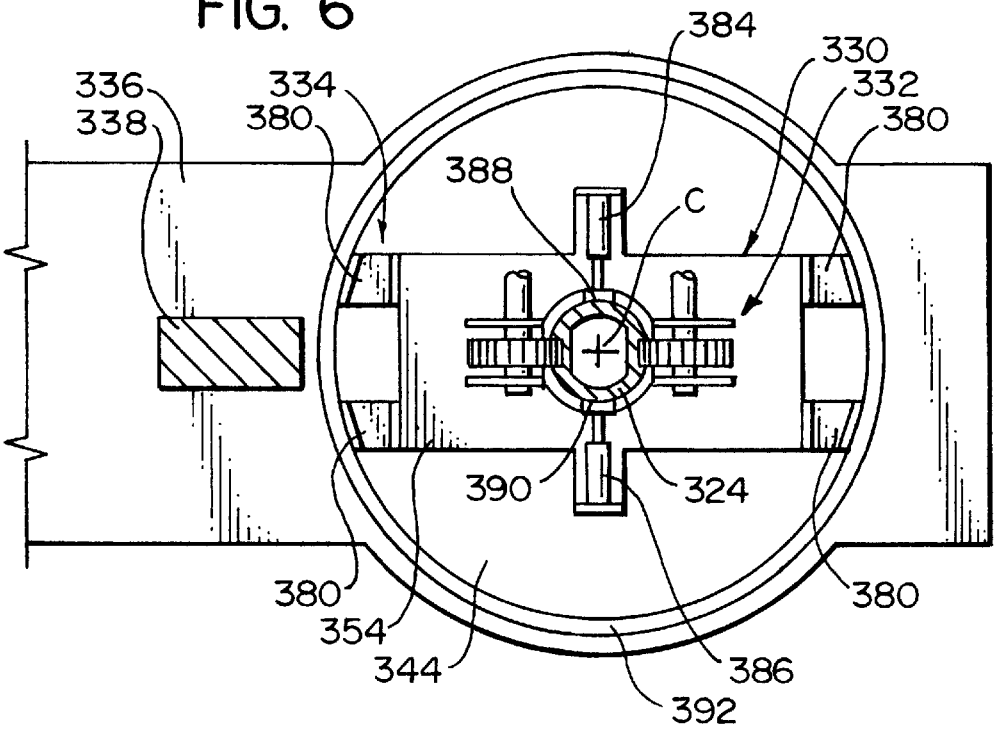
FIG. 6 is a top plan view of a portion of a third exemplary elongate member insertion/removal system that is constructed in accordance with the principles of the present invention.

A third exemplary elongate member insertion/withdrawal system will now be described with reference to FIG. 6. In FIG. 6, components that are essentially the same as those described above with reference to FIGS. 1–4 and will be given the same reference character plus three hundred. Such like components will be described below only to the extent that they differ from the corresponding components described above.

As shown in FIG. 6, in this third exemplary system the channel 344 in the support base 336 is cylindrical. Further, the shock absorbing means 380 of the shock absorbing assembly 334 are connected between the vibratory housing 354 and an intermediate ring 392 mounted onto the support base 336 within the channel 344. The intermediate ring 392 is rotatable about the mandrel axis C relative to the support base 336. Further, the mandrel 334 itself is rounded.

In use, the intermediate ring 392, and thus the vibratory assembly 330, gear drive assembly 332, and mandrel 324, may be rotated about the mandrel axis C. In certain situations rotation of the mandrel 324 may be needed to overcome soil conditions and drive the mandrel 324 into or remove the mandrel 324 from the ground 22. The rounded configuration of the mandrel 324 facilitates the rotation thereof about its axis.

3. Fourth Embodiment

Referring now to FIGS. 7–10, depicted at 420 therein is yet another wick drain inserting system constructed in accordance with, and embodying, the principles of the present invention.

The system 420 comprises an insertion assembly 422 that is pivotably connected to an arm 424 by a pin 426. The arm 424 is connected to an excavator or crane (not shown) such that the insertion assembly 422 may be moved from place to place. An actuator assembly 428 is connected between the insertion assembly 422 and the arm 424. The effective length of the actuator assembly 428 may be increased or decreased; operating the actuator assembly 428 thus rotates the insertion assembly 422 about the longitudinal axis of the pin 426, thereby allowing an angle between the insertion assembly 422 and the arm 424 to be changed.

During use, the actuator assembly 428 thus allows the insertion assembly 422 to be arranged in a proper orientation with respect to the ground. During transportation and storage, the effective length of the actuator member 428 may be decreased so that the insertion assembly 422 is folded back substantially parallel to the arm 424.

The insertion assembly 422 comprises a mast or boom assembly 430, a housing assembly 432, a mandrel assembly 434, a linear drive assembly 436, a vibration assembly 438, a suppression assembly 440 (FIG. 9), and a feed subsystem 442.

Figure 7:
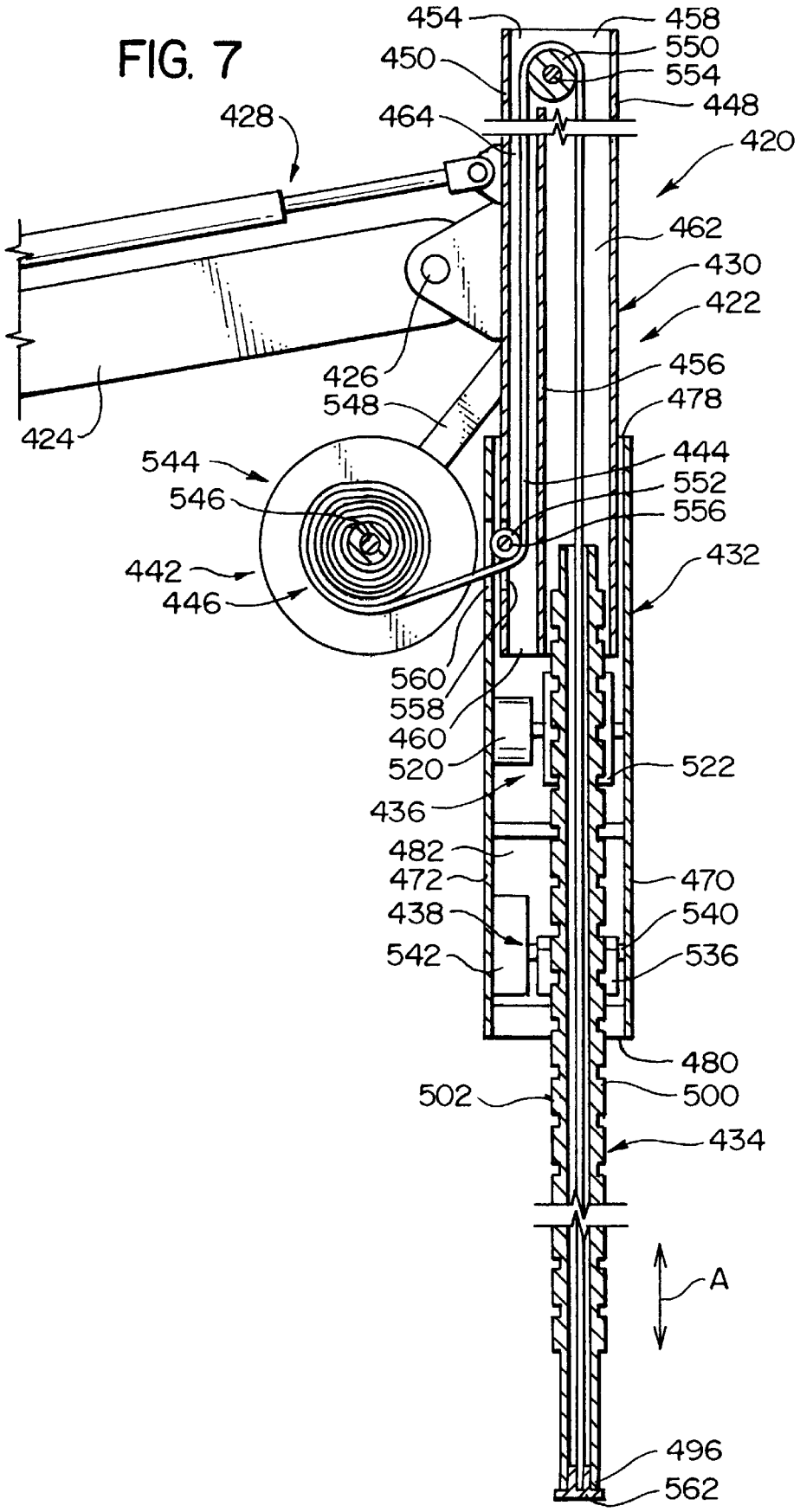
FIG. 7 is a vertical section view of an insertion assembly constructed in accordance with, and embodying, the principles of the present invention.

The linear drive assembly 436 is arranged to displace the mandrel assembly 434 along its axis relative to the housing assembly 432 (in the direction shown by arrow A in FIG. 7). The linear drive assembly 436 also transfers loads on the housing assembly 432 to the mandrel assembly relative.

The vibration assembly 438 may be operated to cause the housing assembly 436 to vibrate in the direction shown by arrow A. Vibratory forces on the housing assembly 436 are transferred to the mandrel assembly 434 by the mandrel drive assembly 436.

The suppression assembly 440 connects the mast assembly 430 to the housing assembly 432 such that the housing assembly 432 may move within a limited range relative to the mast assembly 430. The purpose of the suppression assembly 440 is to inhibit the transfer of the vibratory loads from the housing assembly 440 to the mast assembly 430.

The feed subsystem 442 is configured to feed wick drain material 444 from a roll 446 into the mandrel assembly 434.

The insertion system 420 operates basically as follows. The arm 424 is moved and actuator assembly 428 operated until the insertion assembly 422 is vertically arranged above a desired location at which the wick drain material 444 is to be inserted into the earth. The linear drive assembly 436 is operated to crowd the mandrel assembly 434 into the earth at the desired location. In many situations, excessive resistance will not be encountered, and the linear drive assembly 436 alone will drive the mandrel assembly 434 to its desired depth.

Should the system 420 encounter excessive resistance using the linear drive assembly 436 alone, the vibration assembly 438 may be operated. In most cases, excessive resistance can be overcome by the combination of crowding using the linear drive system 436 and the vibratory loads generated by the vibration assembly 438. Accordingly, both the linear drive assembly 436 and the vibration assembly 438 will be used together whenever excessive resistance is encountered.

Once the excessive resistance is overcome, the vibration assembly 438 will be turned off; in general, vibration is hard on equipment and thus should be used only when necessary.

After the mandrel assembly 434 has been driven to its desired depth, the linear drive assembly 436 will be reversed to withdraw the mandrel assembly 434 from the ground.

With the foregoing basic explanation in mand, the details of construction and operation of the system 420 will now be described in further detail.

Figure 9:
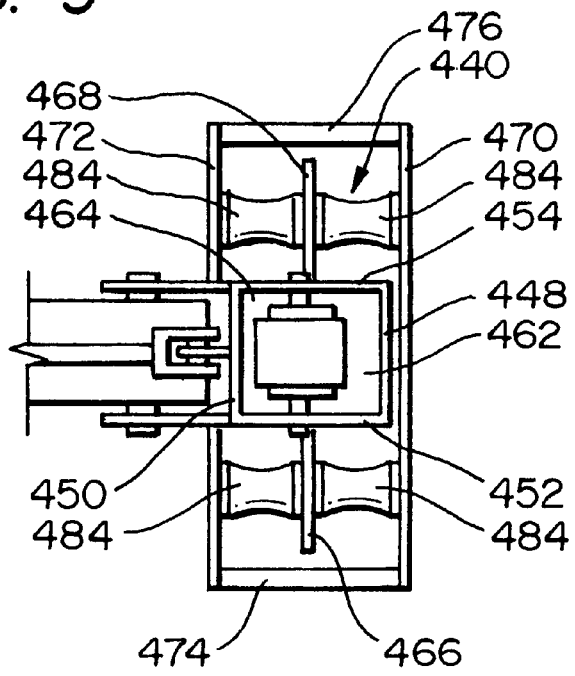
FIG. 9 is a top plan view of the insertion assembly of FIG. 7 with background details omitted for clarity.

As perhaps best shown in FIGS. 7 and 9, the mast assembly 430 comprises a front wall 448, a back wall 450, a first side wall 452, a second side wall 454, and an interior wall 456 (FIG. 7). The walls 448–54 are joined together to form an elongate box such that the mast assembly has an open upper end 458 and an open lower end 460. The interior wall 456 divides the interior of the mast assembly 430 into a forward compartment 462 and a rear compartment 464. The mast assembly 430 further comprises first and second side flanges 466 and 468 that rigidly extend from the first and second side walls 452 and 454 adjacent to the mast lower end 460.

Figure 8:
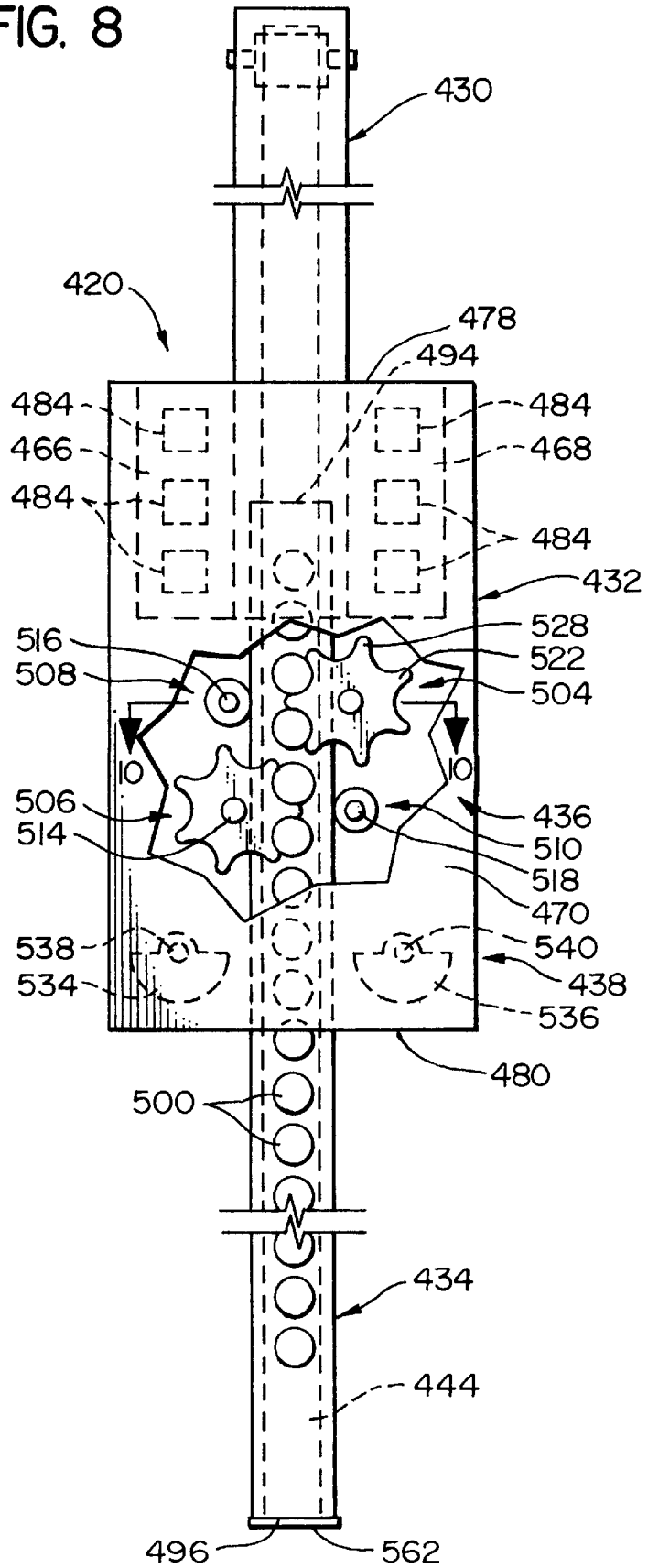
FIG. 8 is a front plan view of the insertion assembly of FIG. 7.

FIGS. 7, 8, and 9 illustrate that the housing assembly 432 comprises a front wall 470, back wall 472, first side wall 474, and second side wall 476. These walls 470–76 are joined together to form a box such that the housing assembly 432 has an open upper end 478 and open lower end 480 and defines a housing chamber 482.

The mast assembly 430 extends through the housing upper end 478 and partially into the housing chamber 482. In particular, as perhaps best shown in FIGS. 8 and 9, the mast flanges 466 and 468 and portions of the mast walls 448–54 adjacent to these flanges 466 and 468 normally reside completely within the housing chamber 482.

The exemplary suppression assembly 440 comprises twelve elastomeric members 484. As shown in FIG. 8, six of these member 484 are connected between front surfaces of the mast flanges 466 and 468 and the rear surface of the housing front wall 470. Six of these members are also connected between rear surfaces of the mast flanges 466 and 468 and the front surface of the housing rear wall 472.

The elastomeric members 484 allow, but resiliently oppose, a small degree of relative movement between the mast assembly 430 and the housing assembly 432. These members 484 thus transfer loads between the mast assembly 430 and the housing assembly 432 but absorb shocks that would otherwise be transmitted between these assemblies. More specifically, these elastomeric members 484 prevent transmission of most vibratory loads and shocks from excessive ground resistance from the housing assembly 432 to the mast assembly 430. This protects the mast assembly 432 and arm 424 from these shocks.

Figure 10:
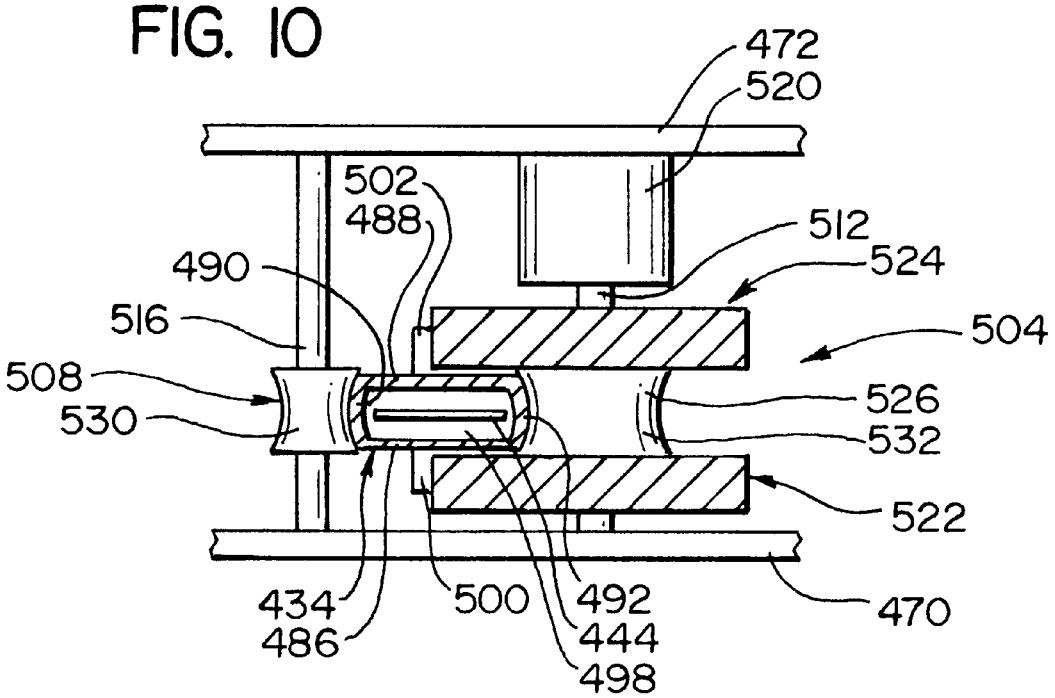
FIG. 10 is a top section view taken along lines 10—10 in FIG. 8, again with background details omitted for clarity.

Referring now to FIG. 10, it can be seen that the mandrel assembly 434 comprises a front wall 486, back wall 488, first side wall 490, and second side wall 492. These walls 486–92 are joined together in an elongate box such that the mandrel assembly has an open upper end 494 and an open lower end 496 and defines a mandrel chamber 498. The front and back walls 486 and 488 are flat, while the side walls 490 and 492 are outwardly curved.

Extending from the front wall 486 is a first row of pins 500, and extend from the back wall 488 is a second row of pins 502. These pins 500 and 502 extend approximately one-half an inch from and are evenly spaced along the length of the mandrel front and back walls 486 and 488. In the preferred embodiment, these pins are short hollow tubes secured by welding to the mandrel walls 486 and 488.

The mandrel assembly 434 is sized and dimensioned such that it may be received within the mast forward compartment 462.

The linear drive system 436 is shown in FIGS. 7, 8, and 10. This system 436 comprises first and second gear assemblies 504 and 506 and first and second roller assemblies 508 and 510. The gear assemblies 504 and 506 are mounted on shafts 512 and 514, and the roller assemblies 508 and 510 are mounted on shafts 516 and 518. The gear assemblies 504 and 506 are or may be almost identical to each other; similarly, the roller assemblies 508 and 510 are or may be almost identical to each other. Accordingly, only the gear assembly 504 and roller assembly 508 will be described in detail herein.

As shown in FIG. 10, the shafts 512 and 516 are connected to inner surfaces of the housing front wall 470 and housing rear wall 472. The gear shaft 512 is axially rotated by a hydraulic motor 520. The motor 520 is conventional and will not be discussed herein in detail.

The gear assembly 508 comprises first and second gear members 522 and 524 and a center portion 526. The gear members 522 and 524 comprise a series of teeth 528 radially extending from the shaft 512. The shafts 512 and 516 are configured such that the center portion 526 opposes the roller assembly 508.

The gear center portion 526 engages the mandrel second side wall 492 and the roller assembly 508 engages the mandrel first side wall 490. The center portion 526 and roller assembly 508 are arranged to prevent significant lateral motion of the mandrel assembly 434 relative to the housing assembly 432.

As shown in FIG. 10, the mandrel assembly 434 extends between the gear assembly 504 and the roller assembly 508. In particular, the gear assembly 504 straddles the mandrel assembly 434 such that the gear members 522 and 524 extend over a portion of the mandrel front and back walls 486 and 488, respectively. The teeth 528 extend between the pins 500 and 502 such that movement of the teeth 528 is transferred to the mandrel assembly 434.

Accordingly, when the motor 520 axially rotates the shaft 512, the gear members 522 and 524 rotate about the axis of the shaft 512; the gear teeth 528 engage the mandrel pins 500 and 502 such that, as the gear members 522 and 524 rotate, the mandrel assembly 434 is driven along its longitudinal axis. In particular, with reference to FIG. 8, clockwise rotation of the gear assembly 504 will result in upward movement of the mandrel assembly 434, while counterclockwise rotation of the gear assembly 504 will result in downward movement of the mandrel assembly 434.

In addition, the teeth 528 engage the pins 500 and 502 and the gear center portion 526 and roller assembly 508 engage the mandrel side walls 490 and 492 such that loads on the housing assembly 432 are transferred to the mandrel assembly 434, and vice versa.

In particular, the teeth 528 are contoured such that each tooth extending between two pins is in contact with the pin above and pin below. This transfers vertical loads between the housing assembly 432 and mandrel assembly 434 and reduces play in the system when the direction in which the mandrel assembly 434 is driven needs to be changed. The roller assembly 508 and gear center portion 526 have concave outer surfaces 530 and 532 that match the convex side walls 490 and 492 of the mandrel assembly 434. And the gear members 522 and 524 are closely arranged adjacent to the mandrel front and back walls 486 and 488. This configuration ensures that front-back, side, and vertical loads are all transferred between the housing and mandrel assemblies 432 and 434 without substantial movement between these assemblies.

As shown in FIG. 8, the vibration assembly 438 comprises a pair of eccentric weights 534 and 536 mounted on shafts 538 and 540 extending between the front and back housing walls 470 and 472. A conventional hydraulic motor 542 rotates the weights 534 and 536 in synchrony in opposite directions to develop a vertical vibratory force that is applied to the housing assembly 432 through the shafts 538 and 540.

As described above, vertical loads on the housing assembly 432 are applied to the mandrel assembly 434 by the gear assemblies 504 and 506 and roller assemblies 508 and 510. Thus, the vibratory forces generated by the vibration assembly 438 are transmitted to the mandrel assembly 434.

Referring again to FIG. 7, it can be seen that the feed subsystem 442 comprises a reel assembly 544 mounted on a shaft 546 extending between to reel struts 548 (only one shown in FIG. 7). The roll 446 of wick drain material 448 is placed onto the reel assembly 544.

The feed subsystem 442 further comprises upper and lower feed rollers 550 and 552 mounted on the mast assembly 430 adjacent to the mast upper and lower ends 458 and 460, respectively. As shown in FIG. 9, the upper feed roller is mounted on a shaft 554 extending between the mast side walls 452 and 454 above an upper edge surface of the internal wall 456. The lower roller 552 is mounted on a shaft 556 extending between the side walls 452 and 454 within a mast feed hole 558 formed in the mast back wall 450. A housing feed hole 560 is formed in the housing back wall 472 adjacent to the mast feed hole 558.

The wick drain material 444 is fed from the roll 446, through the housing feed hole 560 and mast feed hole 558, under the lower feed roller 552, through the rear mast compartment 464, over the upper feed roller 550, through the forward mast compartment 462, through the mandrel chamber 498, and to the mandrel lower end 496. At the mandrel lower end 496, the wick material 444 is attached to a wick drain shoe 562.

With the foregoing more detailed understanding of the construction of the system 420, the use of this system 420 will now be described in further detail.

A first operator will be sitting in an excavator or crane from which the arm 424 extends. A second operator will be on foot.

The first operator can look down the arm 424 towards the housing back wall 472. The excavator or crane is basically conventional, so the first operator may control the position of the insertion assembly 422 by operating the excavator or crane and the hydraulic assembly 428. The first operator thus arranges the insertion assembly 422 such that the mandrel lower end is located above the desired location where the wick drain material is to be inserted and the mast is at the appropriate angle with respect to vertical.

One of the operators operates the linear drive assembly 436 to rotate the gear assemblies 504 and 506, thereby crowding the mandrel assembly 434 into the earth. Because the wick drain material 444 is attached to the shoe 562, as the mandrel assembly 434 is crowded into the earth, the wick drain material 44 is taken off of the roll 446 by the feed subsystem 442 and placed into the earth with the mandrel assembly 434.

Should the mandrel assembly 434 encounter excessive ground resistance, the operators will notice the housing assembly 432 begin to move up relative to the boom assembly 430 by stretching the resilient members 484. At this point, the operator can operate the vibration assembly 438; this will cause the housing assembly 432 to move up and down at a rate related to the rotational speed of the weights 434. This up and down movement will be transferred to the mandrel assembly 434, which will help to overcome the excessive resistance and allow the mandrel assembly 434 to be crowded through the obstruction in the soil. The vibration assembly 438 is then turned off until another obstruction is encountered.

After the mandrel assembly 434 has been driven to its desired depth, the direction of the linear drive system 436 is reversed to withdraw the mandrel assembly 434 from the earth. Because the shoe 562 is not attached to mandrel assembly 434, the shoe 562 remains at the desired depth; and because the wick drain material 444 is attached to the shoe 562, the wick drain material remains in the hole formed by the mandrel assembly 434.

When the mandrel assembly 434 is completely withdrawn from the ground, the second operator will cut the wick drain material 444 above the ground and attach a new shoe 562 thereto. The system 420 is then moved to place the insertion assembly 422 at a new desired location, and the process described above is repeated.

The present invention provides a number of advantages over prior art methods.

By keeping the drive and vibration assemblies close to the ground, the mast need not be heavy. This allows potentially taller masts, as the mast only needs to bear the weight of the wick drain material; the linear drive assembly will support the mandrel. The mast assembly may even be constructed with a metal lower portion that is connected to the excavator arm and housing assembly and a plastic upper portion for supporting the wick drain material. With a light mast, the entire system can be made small and transportable, even to the extent that it can be mounted on a conventional excavator or crane with a large vertical mast. And this lightweight mast can be rotated downward for easy transportation and storage.

By driving the mandrel through the center of the vibration assembly, the vibrational loads are symmetrically applied to the mandrel. Such symmetrical loads reduce wear and tear on the mandrel and decrease the chance that the mandrel will fail during vibration.

The mandrel itself has a very small footprint. This is important as it reduces the amount that the mandrel compacts the soil as it is being driven into the earth. Compaction is a problem because it can interfere with flow of water to the wick drain for wicking to the surface.

The arrangement of two gear assemblies each having two gear members helps to balance the loads while the mandrel is being crowded into the ground. This arrangement also helps ensure that the vibratory loads applied to the mandrel are balanced. The placement of one gear assembly above the other allows the gear teeth to extend over half way between the mandrel pins, thus ensuring a secure transfer of downward motion to the mandrel. The vertically staggered gear teeth also force dirt out from between adjacent mandrel pins, removing dirt that might interfere with the insertion or removal of the mandrel.

This system of the present invention can also be easily manufactured from conventionally available parts.

From the foregoing, it should be clear that the present invention may be embodied in forms other than those described above. The above-described systems are therefore to be considered in all respects illustrative and not restrictive, the scope of the invention being indicated by the appended claims rather than the foregoing description. All changes that come within the meaning and scope of the claims are intended to be embraced therein.

What is claimed is:

1. An apparatus for inserting elongate members into the ground, comprising:

support means for maintaining the elongate member in a desired orientation with respect to the ground;

vibratory means for generating a vibratory force;

shock absorbing means for mounting the vibratory means onto the support means to reduce the transmission of vibratory forces from the vibratory means to the support means;

drive means mounted on the vibratory means for engaging the elongate member such that vibratory loads generated by the vibratory means are transmitted to the elongate member; and displacing the elongate member along an axis thereof relative to the vibratory means; wherein the elongate member comprises first and second drive racks arranged on opposing surfaces thereof; and the drive means comprises first and second gears, where each of the first and second gears engages one of the first and second drive racks to facilitate driving of the elongate member into the ground.

2. An apparatus as recited in claim 1, in which the support means comprises:

a support base on which the vibratory means are mounted by the shock absorbing means; and a boom extending from the support base for supporting the elongate member prior to insertion of the elongate member.

3. An apparatus as recited in claim 2, in which a channel is formed in the support base, where the drive means is mounted adjacent to the channel and the elongate member extends through the channel.

4. An apparatus as recited in claim 1, in which the vibratory means comprises:

first and second eccentric members;

housing in which the first and second eccentric members are mounted; and means for rotating the first and second eccentric members to cause the housing to vibrate along a vibratory axis; wherein an opening is formed in the housing, and the elongate member extends through the opening such that the axis of the elongate member coincides with the vibratory axis.

5. An apparatus as recited in claim 1, further comprising means for rotating the drive means about the axis of the elongate member relative to the support means to rotate the elongate member as the elongate member is displaced along the axis of the elongate member.

6. An apparatus as recited in claim 1, further comprising hydraulic means for engaging and driving the elongate member a limited distance along the axis of the elongate member.

7. An apparatus as recited in claim 1, in which the elongate member is a mandrel for carrying wick drain material into the ground, further comprising:

a support base on which the vibratory means are mounted by the shock absorbing means; and a boom extending from the support base for supporting the elongate member prior to insertion of the elongate member.

8. An apparatus for inserting elongate members into the ground, comprising:

support means for maintaining the elongate member in a desired orientation with respect to the ground;

a housing;

first and second eccentric members securely mounted within the housing;

rotational drive means for so rotating the first and second eccentric members in opposite directions that the housing vibrates along a vibratory axis;

shock absorbing means for mounting the housing onto the support means to reduce the transmission of vibratory forces from the housing to the support means;

means mounted on the housing for so engaging the elongate member that vibratory forces on the housing are transmitted to the elongate member; where the elongate member passes through an opening in the housing between the first and second eccentric members; wherein the elongate member comprises first and second drive racks arranged on opposing surfaces thereof; and the rotational drive means comprises first and second gears, where each of the first and second gears engages one of the first and second drive racks to facilitate driving of the elongate member into the ground.

9. An apparatus as recited in claim 8, in which the support means comprises:

a support base on which the vibratory means are mounted by the shock absorbing means; and a boom extending from the support base for supporting the elongate member prior to insertion of the elongate member.

10. An apparatus as recited in claim 9, in which a channel is formed in the support base, where the drive means is mounted adjacent to the channel and the elongate member extends through the channel.

11. An apparatus as recited in claim 8, further comprising means for rotating the drive means about the axis of the elongate member relative to the support means to rotate the elongate member as the elongate member is displaced along the axis of the elongate member.

12. An apparatus as recited in claim 8, further comprising hydraulic means for engaging and driving the elongate member a limited distance along the axis of the elongate member.

13. An apparatus as recited in claim 8, in which the elongate member is a mandrel for carrying wick drain material into the ground, further comprising:

a support base on which the vibratory means are mounted by the shock absorbing means; and a boom extending from the support base for supporting the mandrel prior to insertion of the mandrel.

14. An apparatus for inserting an elongate member into the ground, comprising:

a support base for engaging the ground, the support base defining a channel through which the elongate member extends as the elongate member is inserted into the ground;

a vibratory device comprising first and second eccentric members that rotate in opposite directions to create vibratory forces, where the eccentric members are spaced on opposite sides of the channel from each other;

a shock absorbing system comprising resilient members operatively connected between the support base and the vibratory device, where the resilient members reduce the transmission of vibratory forces from the vibratory device to the support base, and a drive system comprising first and second sets of drive projections operatively connected to opposing sides of the elongate member and first and second drive gears operatively mounted to the vibratory device to engage the first and second sets of drive projections, where vibratory loads generated by the vibratory device are transmitted to the elongate member through the drive gears and drive projections and rotation of the drive gears cause the drive gears to engage the drive projections to displace the elongate member along an axis thereof relative to the support base.

15. An apparatus as recited in claim 14, in which the first and second drive gears each comprise a first drive gear portion and a second drive gear portion, where the first drive gear portions engage the first set of drive projections and the second drive gear portions engage the second set of drive projections.

16. An apparatus as recited in claim 15, in which the first and second drive gears each comprise a center drive gear portion adapted to engage and support the elongate member.

17. An apparatus as recited in claim 15, further comprising first and second roller members operatively connected to the vibratory device to engage and support the elongate member opposite the center drive gear portions of the first and second drive gears, respectively.

18. An apparatus as recited in claim 14, in which:

the drive projections comprise first and second racks formed on opposing sides of the elongate member; and the drive means comprises first and second drive gears arranged to engage the first and second racks, respectively.

19. An apparatus as recited in claim 14, in which the elongate member is a mandrel for carrying wick drain material into the ground.

20. An apparatus for inserting an elongate member into the ground, comprising:

a support base comprising means for engaging the ground;

a housing defining an opening through which the elongate member extends as the elongate member is inserted into the ground;

first and second eccentric members rotatably mounted within the housing on opposing sides of the opening;

a rotational drive system for so rotating the first and second eccentric members in opposite directions that the housing vibrates along a vibratory axis, where the first and second eccentric members are mounted to the housing on opposing sides of the opening;

a shock absorbing system comprising resilient members that mount the housing onto the support means to reduce the transmission of vibratory forces from the housing to the support means; and an engaging system mounted on the housing comprising first and second engaging members arranged on opposite sides of the elongate member to engage the elongate member and transmit vibratory forces from the housing to the elongate member.

21. An apparatus as recited in claim 20, in which the engaging members are first and second drive gears, further comprising first and second sets of drive projections formed on opposing sides of the elongate member such that the first and second drive gears engage the first and second sets of drive projections and rotation of the drive gears displaces the elongate member relative to the housing.

22. An apparatus as recited in claim 21, in which the first and second drive gears each comprise a first drive gear portion and a second drive gear portion, where the first drive gear portions engage the first set of drive projections and the second drive gear portions engage the second set of drive projections.

23. An apparatus as recited in claim 22, in which the first and second drive gears each comprise a center drive gear portion adapted to engage and support the elongate member.

24. An apparatus as recited in claim 23, further comprising first and second roller members operatively connected to the vibratory device to engage and support the elongate member opposite the center drive gear portions of the first and second drive gears, respectively.

25. An apparatus as recited in claim 20, in which the elongate member is a mandrel for carrying wick drain material into the ground.

* * * * *